US007621727B2

(12) United States Patent
Chen

(10) Patent No.: US 7,621,727 B2
(45) Date of Patent: Nov. 24, 2009

(54) AUTOMOBILE COMPRESSOR PISTON

(76) Inventor: Po-Lin Chen, 4F.-1, No. 98, Sec. 2, Zhongxiao E. Rd., Taipei City (TW)

( * ) Notice: Subject to any disclaimer, the term of this patent is extended or adjusted under 35 U.S.C. 154(b) by 757 days.

(21) Appl. No.: 11/222,857

(22) Filed: Sep. 12, 2005

(65) Prior Publication Data

US 2007/0059190 A1 Mar. 15, 2007

(51) Int. Cl.
*F04B 17/00* (2006.01)

(52) U.S. Cl. ..... 417/545; 417/307

(58) Field of Classification Search ..... 417/545, 417/305, 7, 308, 415, 440, 550, 551, 555.13
See application file for complete search history.

(56) References Cited

U.S. PATENT DOCUMENTS 4,413,451 A * 11/1983 Featherstone et al. ..... 52/28
6,783,333 B2 * 8/2004 Wang ..... 417/307

* cited by examiner

*Primary Examiner*—Charles G Freay
*Assistant Examiner*—Patrick Hamo
(74) *Attorney, Agent, or Firm*—Raymond Y. Chan; David and Raymond Patent Firm

(57) ABSTRACT

A piston used in a vehicle air-compressor or a vehicle suspension system can be dismantled by a dismantling tool so that cost for a repair is reduced while components are replaceable instead of the whole piston.

3 Claims, 4 Drawing Sheets

AUTOMOBILE COMPRESSOR PISTON

FIELD OF THE INVENTION

The present invention relates to a piston; and more particularly, relates to an automatic compressor piston which is dismantled and adjustable.

DESCRIPTION OF THE RELATED ARTS

A piston 7 of a prior art for an air compressor is disclosed, as shown in FIG. 4, where the air compressor comprises a base seat, a motor fixed to the base seat, a cylinder liner on the base seat for deposing the piston 7, and a weight block with an cam jointed to a rod 72 of the piston 7 directly or indirectly driven by the motor. The prior art is characterized in that the piston 7 comprises a piston head 71 and a rod 72 extended downwards from the bottom of the piston head 71, where the rod 72 comprises a shaft hole 73 at the end to joint to the cam of the weight block. On the side surface around the piston head is deposed a ring notch 74 concaving toward the axle center, where a piston ring 8 is slipped in. A plurality of gas holes 75 are deposed near the circumference on the top surface of the piston head 71; and the gas hole 75 is led to the ring notch 74.

Although air can be exhausted in the prior art, the piston therewithin is formed integrally; so, when a replacement is required out of a breakdown, the whole piston is replaced, but this is wasted in cost. Therefore the prior art does not satisfy users' requests on actual use.

SUMMARY OF THE INVENTION

Therefore, the main purpose of the present invention is to provide a piston with cost reduction, while the piston is dismantled and adjusted.

To achieve the above purpose, the present invention discloses an automobile compressor piston, which comprises a packing, a piston ring, a connecting rod, a bearing and an cam; and the piston can be dismantled by using a dismantling tool. Accordingly, a novel automobile compressor piston is obtained.

BRIEF DESCRIPTIONS OF THE DRAWINGS

The present invention will be better understood from the following detailed description of the preferred embodiment according to the present invention, taken in conjunction with the accompanying drawings, in which FIG. 1 is a perspective view of a preferred embodiment according to the present invention;

DESCRIPTION OF THE PREFERRED EMBODIMENT

The following description of the preferred embodiment is provided to understand the features and the structures of the present invention.

Figure 1:
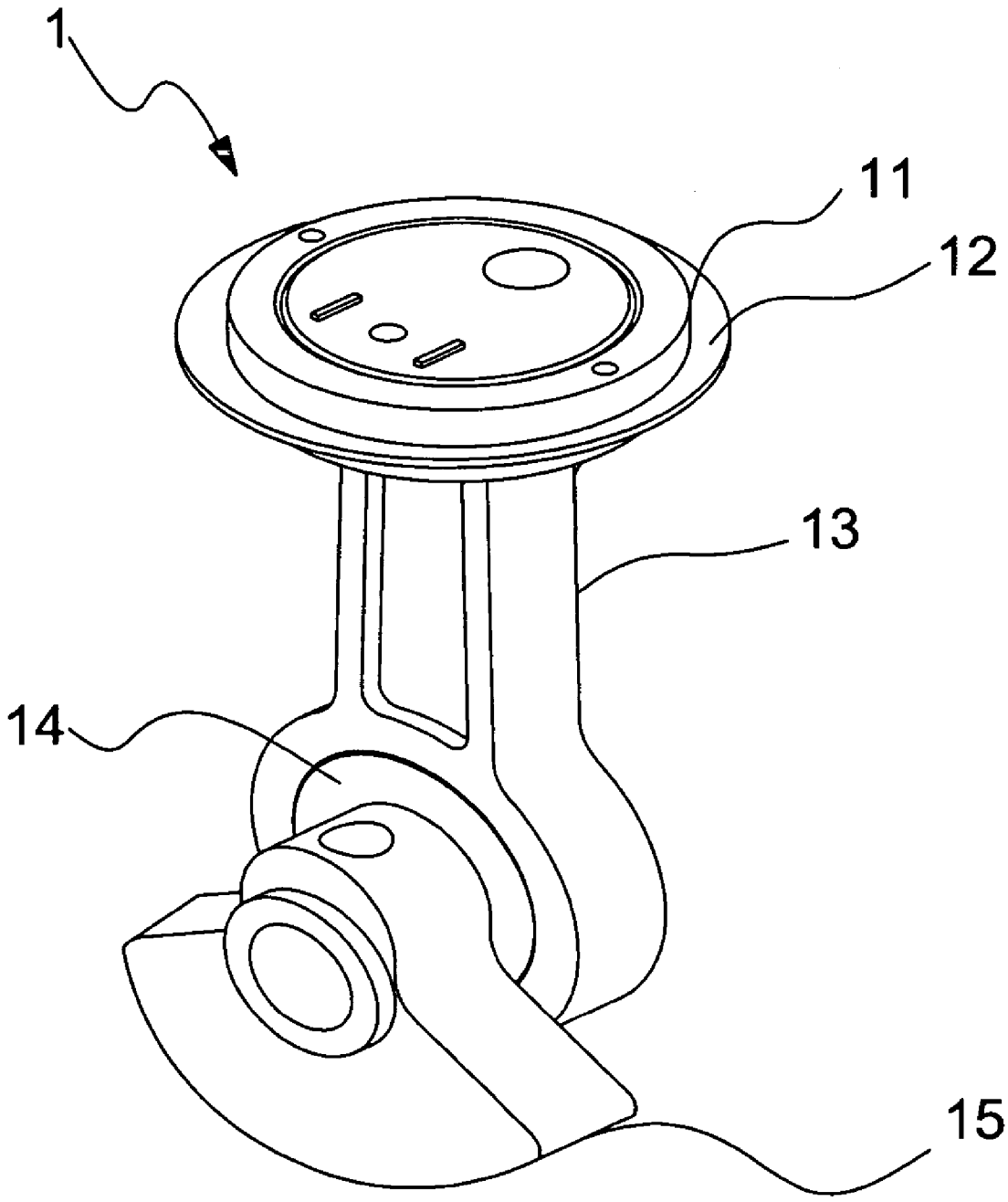

Please refer to FIG. 1, a perspective view of a preferred embodiment according to the present invention is disclosed. As shown in the figure, an automobile compressor piston 1 according to the present invention comprises a packing 111, a piston ring 12, a connecting rod 13, a bearing 14 and a cam 15. The above mentioned components are constructed one after one.

Figure 2:
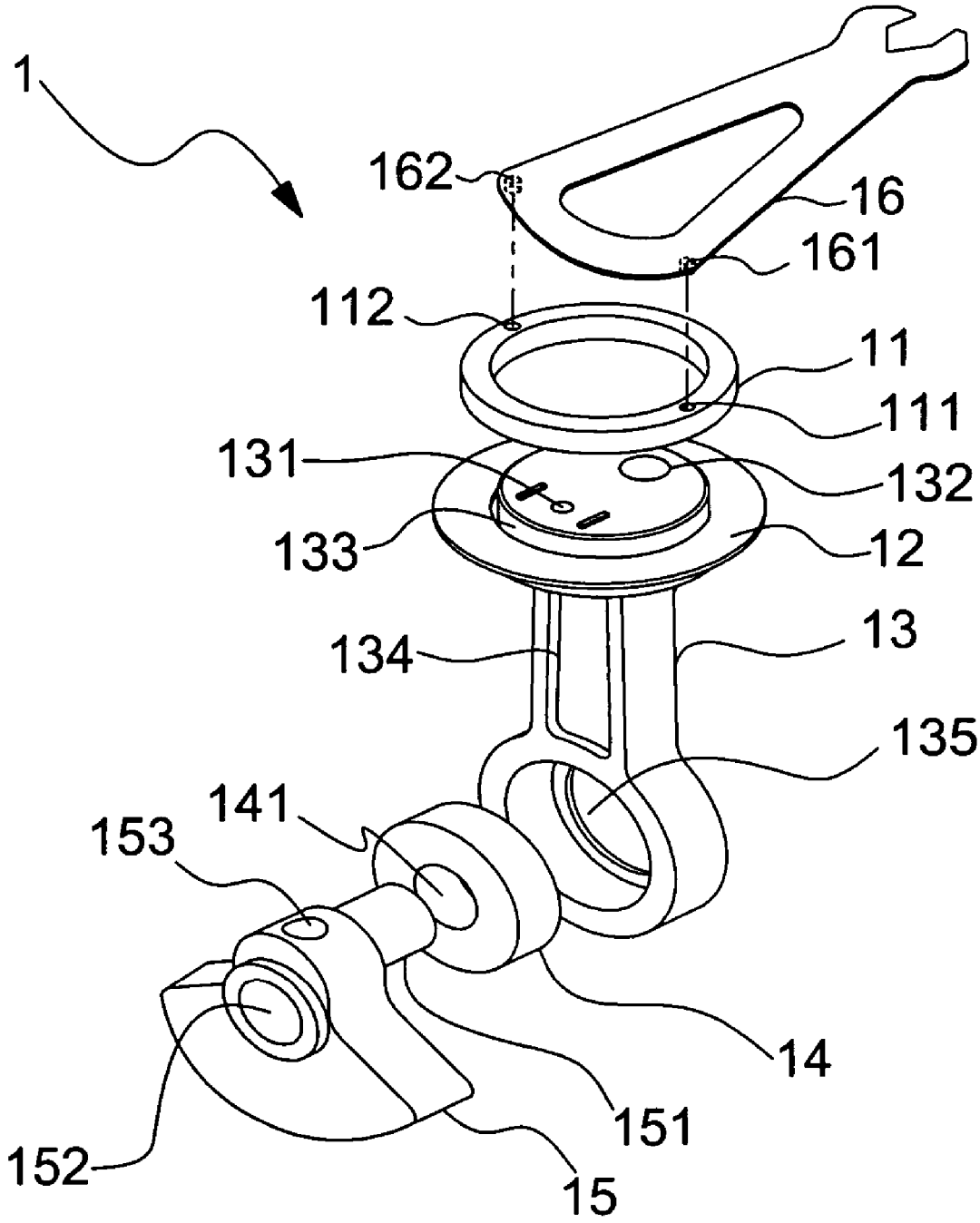
FIG. 2 is an explosive view of the preferred embodiment according to the present invention.

Please refer to FIG. 2, an explosive view of the preferred embodiment according to the present invention is illustrated. As shown in the figure, The automobile compressor piston 1 of the present invention comprises a packing 11, a piston ring 12, a connecting rod 13, a bearing 14 and a cam 15. The packing 11 comprises two fixing holes 111, 112 at one side thereof; the packing 11 can be locked on a top of the connecting rod; and, the packing 11 can be dismantled with the fixing holes 111,112 by using a dismantling tool 16 having two corresponding concave parts 161,162 on the tool 6.

The piston ring 12 is located between the packing 11 and the connecting ring 13 to prevent from friction between the packing 11 and the connecting rod 13 or between two components when used in an air compressor, so that the connecting rod 13 or the components will not be abraded or run unevenly to shorten a lifetime of the piston. Besides, the piston ring 12 is able to accumulate air.

The connecting rod 13 is the main body of the piston 1, comprising a locking hole 131 and a suction valve 132 on a top thereof; a thread part 133 on a side surface of the top for locking the packing 11 on the top; two grooves 134 at a center thereof; and, a round hole 135 at a bottom thereof.

The bearing 14 is deposed in the round hole 135 at the bottom of the connecting rod 13, comprising a shaft hole 141 at center thereof.

The cam 15 comprises a camshaft 151 which can be inserted into the shaft hole 141 of the bearing 14; an eccentric hole 152 on the opposite side surface of to the camshaft 151; and a locking hole 153 on a side surface to the eccentric hole 152. The cam 15 comprises a sector shape section, which is a weight block to drive the piston 1 to move upward and downward by using a motor (not shown in the figure).

Hence, the piston 1 can be dismantled and adjusted, where, on using, components can be replaced to reduce cost without replacing the whole set.

Figure 3:
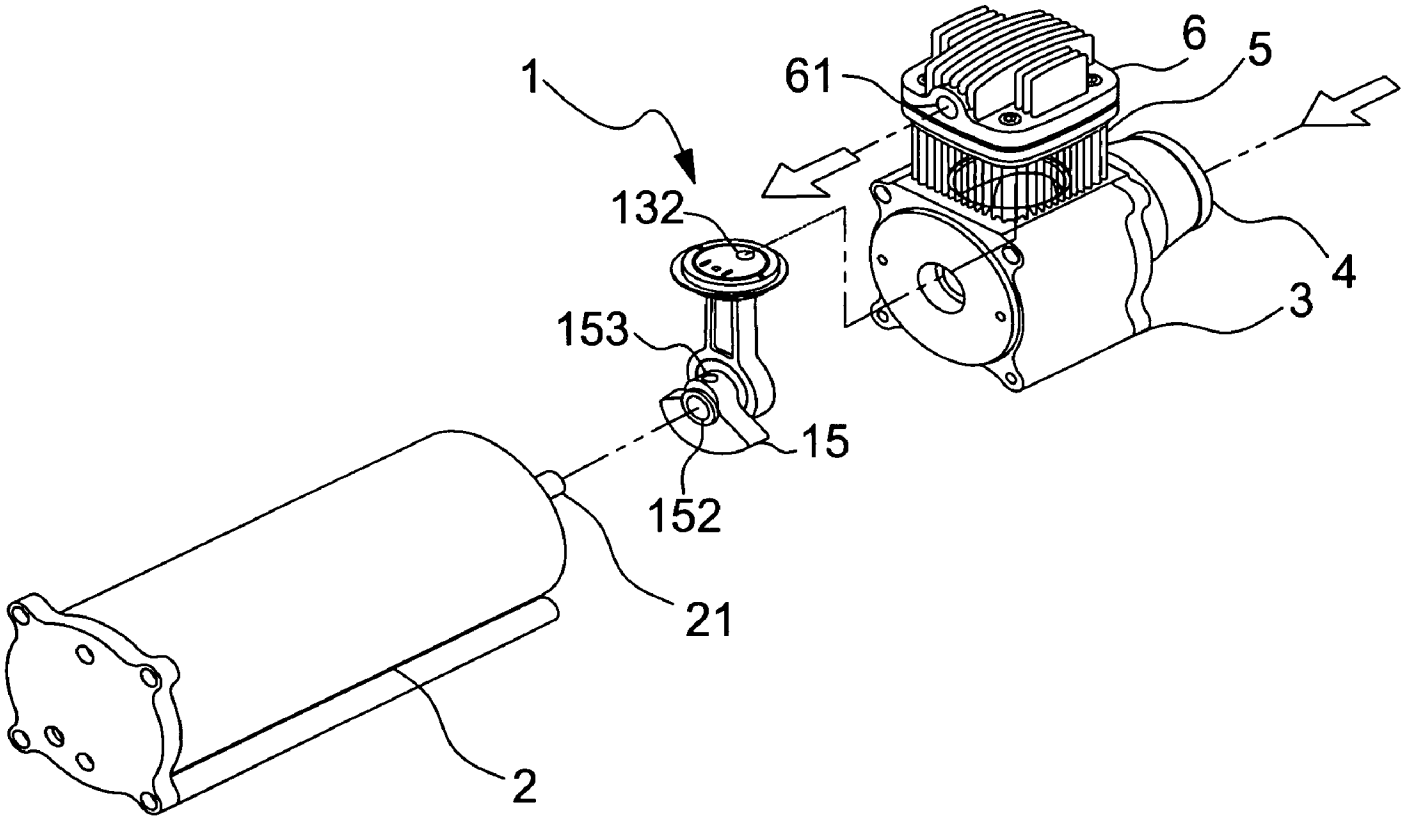
FIG. 3 is a view showing a status of use of the preferred embodiment according to the present invention.
Figure 4:
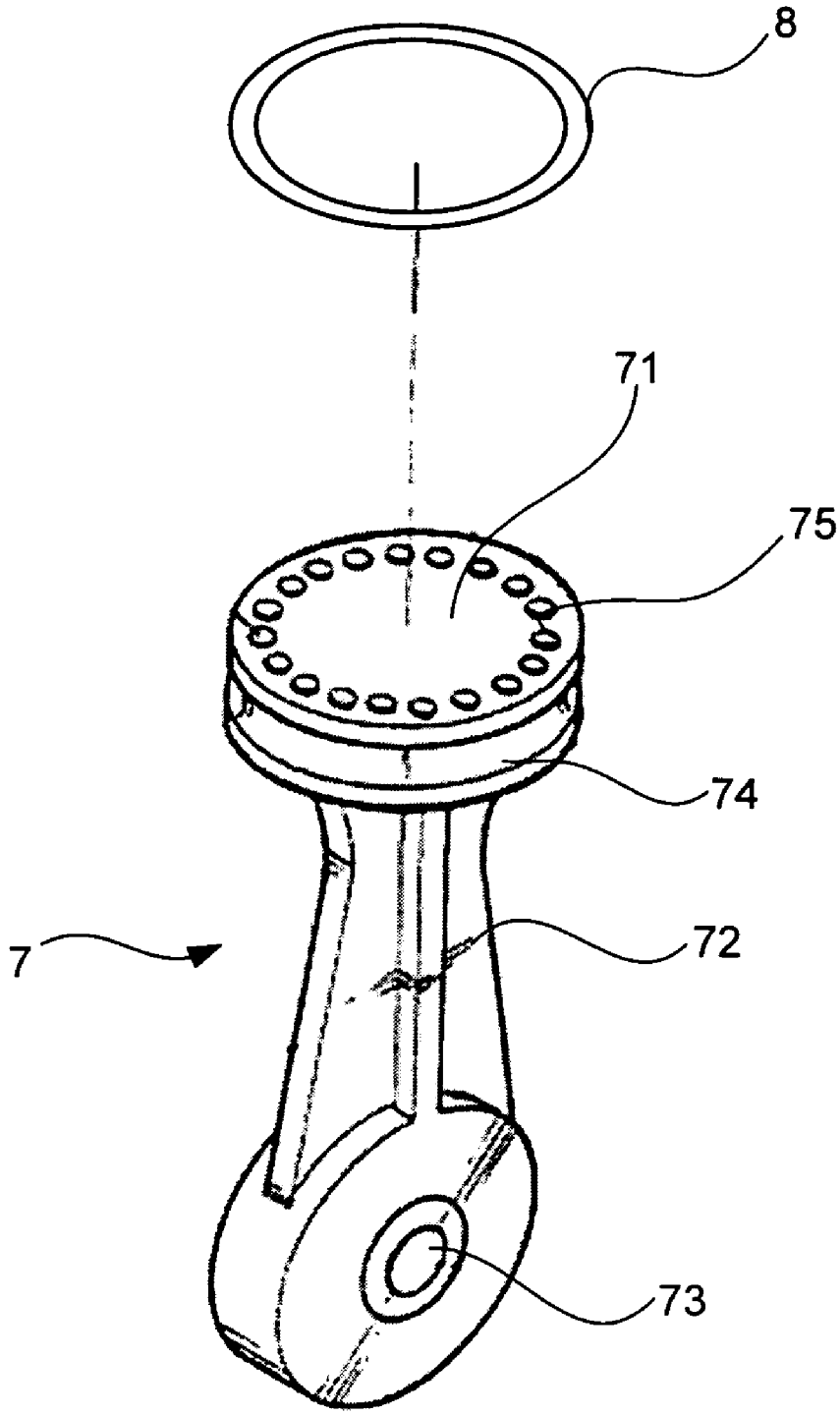
FIG. 4 (Prior Art)
FIG. 4 is a perspective view of a prior art.

Please refer to FIG. 3, a view showing a status of use of the preferred embodiment according to the present invention is illustrated. As shown in the figure, a piston 1 according to the present invention can be used in a vehicle air-compressor or a vehicle suspension system. Those shown in the figure is a vehicle air-compressor. The air-compressor consists of a motor 2, a main seat 3, a filter 4, a piston cylinder 5 and a cylinder head 6. The piston 1 according to the present invention is deposed in the main seat 8. A cam 15 at an end of the piston 1 is connected with the motor 2, where a shaft 21 of the motor 2 is inserted into an eccentric hole 152 of the cam 15 to be fixed with a screw locked into a locking hole 153. Another end of the piston 1 is inserted into the piston cylinder 5. Air enters into the piston cylinder 5 of the vehicle air-compressor from the suction valve 132 through the filter 4 to drive the piston 1 to move upward and downward by using the motor. Air is then pumped and is transferred to an exhaust valve 61 of the cylinder head 6 to be exhausted.

In summary, the present invention is an automobile compressor piston, where a dismantling tool can be used for dismantling so that components of the piston can be replaced without replacing the whole set and so cost can be reduced.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. An automobile compressor piston, comprising:

an automobile compressor piston (1) including a packing (111), a piston ring (12), a connecting rod (13), a bearing (14) and an cam (15); wherein the packing (11) being a ring with a hollow center and including two fixing holes (111, 112) at an upper side thereof;

the piston ring (12) located between the packing (11) and the connecting rod (13) for preventing from friction between the packing (11) and the connecting rod (13) so that the connecting rod (13) will not be abraded or run unevenly;

the connecting rod (13) comprises a locking hole (131) and a suction valve (132) on a top thereof; a thread part (133) on a side surface for locking the packing (11) so that the packing (11) enclosing the thread part (133) of the connecting rod (13); two grooves (134) at a center portion thereof; and, a round hole (135) at a bottom thereof;

the bearing (14) is deposed in the round hole (135) at the bottom of the connecting rod (13), comprising a shaft hole (141) at a center thereof;

the cam (15) comprises a camshaft (151) to be inserted into the shaft hole (141) of the bearing (14); an eccentric hole (152) on an opposite side surface to the camshaft (151); and a locking hole (153) on a side surface to the eccentric hole (152); the cam (15) has a sector shape, which is a weight block to drive the piston (1) to move upward and downward.

2. The air compressor with an automobile compressor piston as claimed in claim 1, further comprising a dismantling tool (16) which has two corresponding concave parts (161, 162) on the too (16); and the packing (11) can be dismantled with the fixing hole (111, 112).

3. The air compressor with an automobile compressor piston as claimed in claim 1, wherein in assembly, the piston (1) is deposed in the main seat (3) of an air compressor; the cam (15) at an end of the piston (1) is connected with a motor (2), where a shaft (21) of the motor (2) is inserted into an eccentric hole (152) of the cam (15) to be fixed with a screw locked into a locking hole (153); another end of the piston (1) is inserted into the piston cylinder (5) of the air compressor; air enters into the piston cylinder (5) of the air-compressor from the suction valve (132) through the filter (4) of the air compressor to drive the piston (1) to move upward and downward by driving of the motor, air is then pumped in and is transferred to an exhaust valve (61) of the cylinder head (6) of the air compressor to be exhausted.

* * * * *